US006358545B1

(12) United States Patent
Chandler et al.

(10) Patent No.: US 6,358,545 B1
(45) Date of Patent: Mar. 19, 2002

(54) BEVERAGE-PRODUCING PACKAGES

(75) Inventors: Kevin Paul Chandler, Hants (GB); Umberto Richichi, Casinalbo (IT)

(73) Assignee: Mars UK Limited (GB)

( * ) Notice: Subject to any disclaimer, the term of this patent is extended or adjusted under 35 U.S.C. 154(b) by 0 days.

(21) Appl. No.: 09/463,360

(22) PCT Filed: Jul. 28, 1998

(86) PCT No.: PCT/GB98/02246

§ 371 Date: May 15, 2000

§ 102(e) Date: May 15, 2000

(87) PCT Pub. No.: WO99/05036

PCT Pub. Date: Feb. 4, 1999

(30) Foreign Application Priority Data

Jul. 28, 1997 (GB) ..... 9715921

(51) Int. Cl.[7] ..... B65B 29/02

(52) U.S. Cl. ..... 426/79; 426/77; 426/78; 426/112; 426/120; 222/129.1; 222/541.3

(58) Field of Search ..... 426/79, 77, 78, 426/112, 120; 222/129.1, 92, 105, 541.3; 383/100, 101, 103, 210

(56) References Cited

U.S. PATENT DOCUMENTS

| | | | | |
|---|---|---|---|---|
| 3,473,725 A | * | 10/1969 | Wiehahn | 383/100 |
| 4,886,674 A | * | 12/1989 | Seward et al. | 426/79 |
| 5,330,269 A | * | 7/1994 | Kamada et al. | 383/210 |
| 5,655,842 A | * | 8/1997 | Hagino | 383/101 |

* cited by examiner

*Primary Examiner*—Philippe Derakshani
(74) *Attorney, Agent, or Firm*—Dorsey & Whitney LLP

(57) ABSTRACT

A beverage producing sachet comprising two laminates bonded at their edges and having a bottom seam with an openable portion thereof sealed by a pressure-sensitive adhesive. The base seam includes a reinforcing plastics strip which is heat sealed to both of the laminates except in the openable portion where it is bonded to one of the laminates by pressure-sensitive adhesive.

5 Claims, 1 Drawing Sheet

BEVERAGE-PRODUCING PACKAGES

FIELD OF THE INVENTION

The present invention relates to beverage dispensing and in particular to packages which provide, from a dispensing machine, a beverage when mixed with water provided from the machine.

BACKGROUND OF THE INVENTION

Prior art beverage dispensing systems which utilize packages of beverage-producing material used in association with a complementary hot water providing machine are well know. In one variation of such known systems, the machine includes a reservoir of hot water communicating with a water injector in the form of a hollow needle. The beverage-producing packages consist of generally planar sachets. The user inserts such a sachet into the machine, and the injector of the latter pierces a plastics nozzle carried in the top seam of the sachet. Hot water under pressure is introduced into the sachet. The beverage is dispensed through the bottom of the sachet. The base seam of the latter is secured by a pressure-sensitive adhesive and is forced open under the pressure of fluid in the sachet. The beverage itself is formed by the hot water mixing with the beverage-producing material held in the sachet. Such a system has been commercially marketed under the Registered Trade Mark "Flavia". The sachets are described, for example, in EP-B-0179641 and the machines in GB-B-2122881.

With ground coffee or leaf tea a sheet of filter material is held within the sachet to support such coffee or tea. When the bottom of the sachet opens due to the pressure of hot water, the tea leaves or coffee grains remain in the sachet, supported by the filter material. By arranging the filter material to have an upward fold, this everts as the base seam of the sachet opens. The downward motion upon eversion assists in providing a predictably even and downwardly-directed opening, so that the beverage streams downwardly into the waiting receptacle, such as a cup or mug, and is not directed sideways so as to create a mess Problems have arisen with, in some instances, the sachet bottom seam opening too vigorously and explosively. This problem can be alleviated by heating the base seam, e.g. with hot air or steam, when the sachet is being opened: see EP-B-0426478.

The dispensing of beverages such as instant drinks or hot chocolate do not require a filter material in the sachet and have their own problems. Taking hot chocolate as an example, this is simply held in the sachet and is forced out into the receptacle with the hot water. There are three criteria one hopes to achieve: cleanout (where all the chocolate powder is washed out of the sachet), dispersion (where all the powder is successfully dispersed with the hot water in the receptacle), and clean dispensing (all of the powder and liquid dropping cleanly into the receptacle). With the Flavia sachets, one can achieve any two of these three criteria easily, but to achieve all three all of the time is difficult.

The reason for this difficulty is the lack of predictability in the opening of the base seam, particularly in the absence of a filter material—as with hot chocolate. The moment a small section of the base seam opens, chocolate powder is sprayed through the opening with hot water and the pressure within the sachet rapidly falls. Thereafter, the base seam may or may not open to a greater degree and can pucker and twist. This can cause any one of the three above criteria not being achieved.

SUMMARY OF THE INVENTION

The present invention is concerned with a solution to this problem.

According to the present invention there is provided a generally-planar sachet as specified in the claims hereinafter.

The invention employs a reinforcing flexible strip in the base seam of the sachet extending across the portion that opens under the action of the pressurized water. It has been found that the presence of such a strip reduces puckering and twisting and the opening rapidly tends to form the shape, in cross-section, of an oval with tapered ends. Such an opening is downwardly directed and enables the three criteria mentioned above to be achieved more easily.

The material forming the sachet is preferably two face-to-face sheets of laminate, each having an outer plastics layer, an intermediate metal foil layer, and an inner plastics layer. The inner layers are heat bonded together around their edges to form the sachet, except in the region of the openable portion where the reinforcing strip is sandwiched between the two layers. The strip, which may be of the same plastics material as each inner layer, is heat bonded to one inner plastics layer. It is heat bonded to the other plastics layer except in the openable portion, where it is bonded with a pressure-sensitive adhesive.

When the sachet is opened under the pressure of the water, the reinforced strip and one laminate forms one side of the opening and is relatively stiff. The other side is formed by the other laminate—to which it had been bonded with pressure-sensitive adhesive. By avoiding having just two very flexible laminates forming the sides of the opening, a more controlled opening may be formed of more even symmetry.

Although the invention is primarily designed for beverages such a hot chocolate, which does not dictate the need for a filter material in the sachet, the invention contemplates the possibility of its use with sachets containing filter material supporting, say, ground coffee or leaf tea.

DESCRIPTION OF THE DRAWINGS

A preferred embodiment of the invention will now be described, by way of example, with reference to the accompanying drawings in which.

DESCRIPTION OF THE PREFERRED EMBODIMENT

Figure 1:
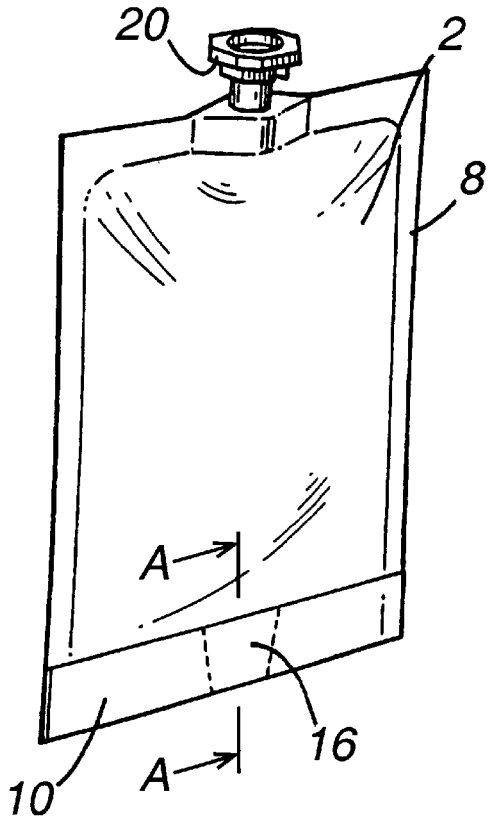
FIG. 1 is a front perspective view of a sachet according to the invention.
Figure 2:
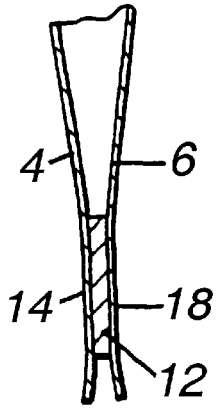
FIG. 2 is a side cross-section of the lower portion of the sachet of FIG. 1, along line A—A.

Referring to the drawings, the sachet 2—which is designed to contain chocolate powder so as to provide a hot chocolate beverage—is formed of two face-to-face laminates 4,6. Each laminate consists of an outer polyester layer (12 $\mu$m thickness), an intermediate aluminium layer (9 $\mu$m) and an inner polypropylene layer (55 $\mu$m). The laminates are heat bonded together, polypropylene to polypropylene at the edge 9 except at the bottom seam 10 where a strip 12 of polypropylene (150–300 $\mu$m thickness) is sandwiched. The strip 12 is heat bonded to the polypropylene layer of one laminate, 4, at 14 and is heat bonded to the polypropylene layer of the other laminate, 6, except in an openable portion 16. In this latter portion it is bonded by pressure-sensitive adhesive 18. In the top edge of the sachet is provided an openable nozzle 20 to receive a hollow needle water injector when a beverage is to be produced.

Figure 3:
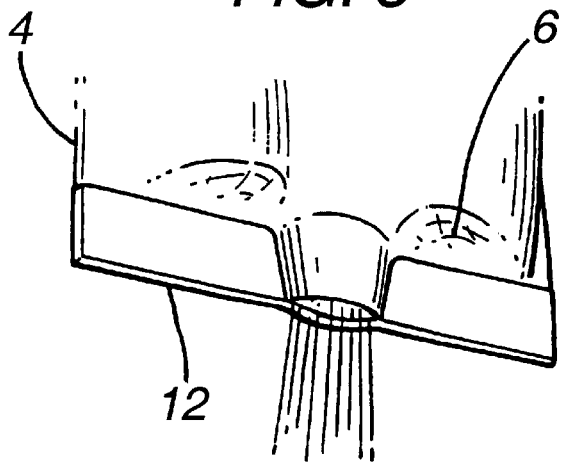
FIG. 3 is a perspective view of the openable portion of the sachet of FIGS. 1 and 2, after opening.

In operation, the sachet is inserted into a suitable dispensing machine, hot water under pressure is introduced into the sachet, and ultimately the pressurized water causes the sachet to open in the openable portion 16. The reinforcing strip 12 and laminate 4 form one edge of the opening, whereas the laminate 6 forms the other edge of the opening. The openable portion tends to form the oval-shaped opening shown in FIG. 3 with much more tendency and regularity than when the reinforcing strip 12 is omitted.

What is claimed is:

1. A generally planar beverage sachet comprising, a pair of face-to face flexible sheets bonded around their edges to define a sachet with an inner volume containing a product, which produces a beverage when mixed with water, said bonded edges including a base seam, said base seam having a portion thereof bonded with a pressure-sensitive adhesive so that when pressurized water is introduced into said sachet said base seam opens in said portion sealed by said pressure-sensitive adhesive, and wherein said base seam includes a flexible reinforcing strip permanently bonded to the inner face of one of said flexible sheets and bonded to the other of said flexible sheets by said pressure-sensitive adhesive at said portion.

2. A sachet according to claim 1 wherein each said flexible sheet comprises a laminated material having an outer plastics layer, an intermediate foil layer and an inner plastics layer.

3. A sachet according to claim 2 wherein said flexible sheets are bonded together by heat sealing said inner plastics layers together except in the area of said base seam which is sealed by pressure-sensitive adhesive.

4. A sachet according to claim 1 wherein said flexible reinforcing strip is of a plastics material.

5. A sachet according to claim 1 wherein said sachet includes an openable nozzle bonded into one edge of said sachet to enable pressurized water to be introduced into said sachet.

* * * * *